United States Patent [19]

Berry

[11] 4,114,782

[45] Sep. 19, 1978

[54] PUMP COUPLING SYSTEM FOR ATTACHMENT TO DRUM

[76] Inventor: Harry E. Berry, 3510 SW. 32nd Ave., Hollywood, Fla. 33023

[21] Appl. No.: 786,350

[22] Filed: Apr. 11, 1977

[51] Int. Cl.[2] ..... B67D 5/42; B65D 47/34

[52] U.S. Cl. ..... 222/382; 222/383

[58] Field of Search ..... 222/379, 382, 383, 400.7, 222/400.8

[56] References Cited

U.S. PATENT DOCUMENTS

| | | | |
|---|---|---|---|
| 1,379,690 | 5/1921 | Hughes et al. | 222/383 |
| 1,906,354 | 5/1933 | Andreasen | 222/400.8 |
| 1,977,360 | 10/1934 | Talbot | 222/382 |
| 2,344,005 | 3/1944 | Sundholm | 222/383 X |

*Primary Examiner*—Robert B. Reeves

*Assistant Examiner*—David A. Scherbel

*Attorney, Agent, or Firm*—Mason, Fenwick & Lawrence

[57] ABSTRACT

A liquid dispensing system comprising drum members each having an upper end wall in which a female connector member is permanently mounted with a suction tube extending from the female coupling member downwardly a lower end termination adjacent the lower end wall of the drum; a male connector member attached to the inlet of a small pump has a mating portion insertable in sealing relationship in the female coupling with rotary retaining structure on the male connector member maintaining the male connector member coupled to the female coupling. The arrangement permits the pump connected to the male coupling member to be easily attached and detached from the drum member.

4 Claims, 5 Drawing Figures

Fig-3
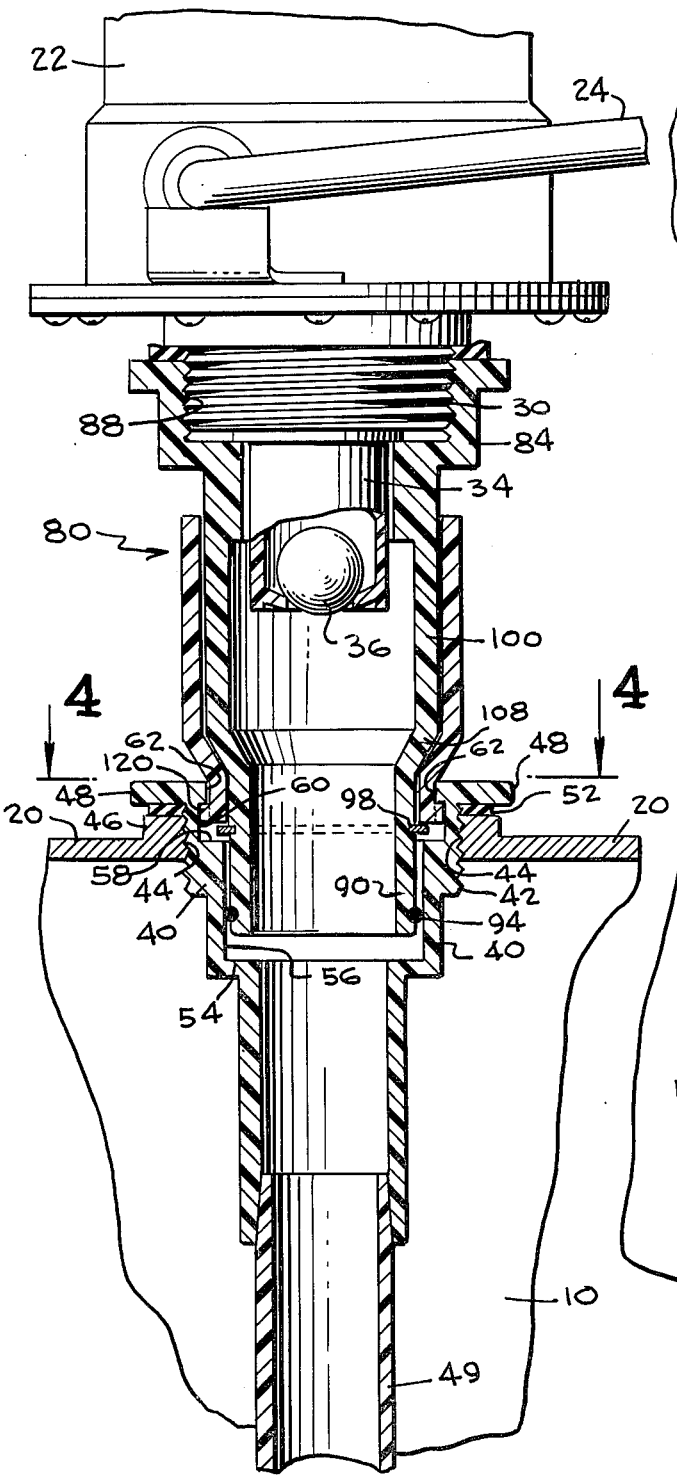
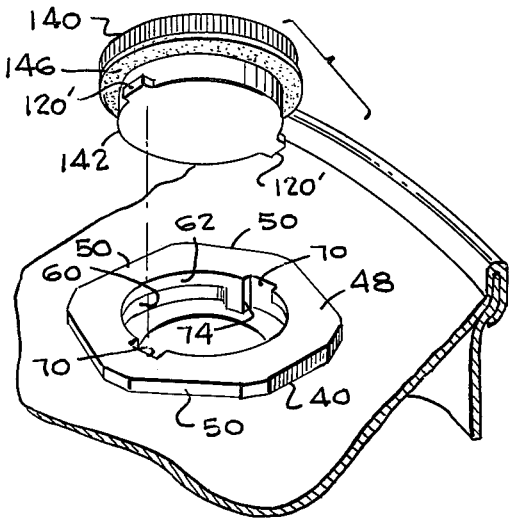
Fig-5
Fig-4
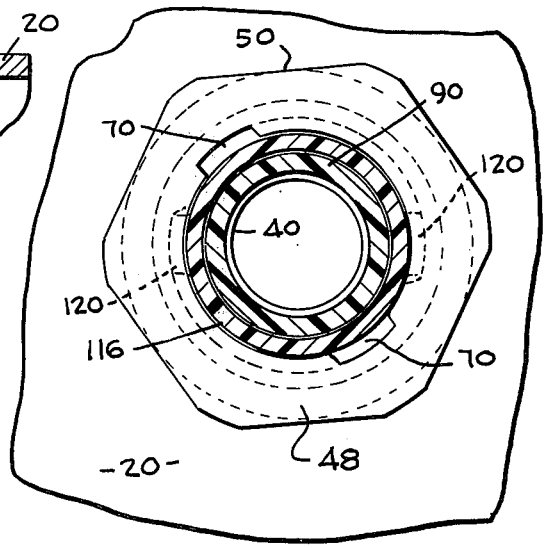

PUMP COUPLING SYSTEM FOR ATTACHMENT TO DRUM

BACKGROUND OF THE INVENTION

This invention is in the field of liquid dispensing means and is particularly directed to the field of means for dispensing liquid from drums or the like.

The removal of liquid contents from within drums has been effected in a variety of ways such as by siphoning and the provision of a spigot on an end wall of the drum so as to permit the drum to be positioned in a horizontal manner for gravitational flow discharge of the liquid contents. Moreover, pumps have also been provided on drum members for enabling the removal of the liquid drum contents. However, the connection of such prior known pump members to the drums is a difficult and time consuming task usually involving the threaded connection of the pumps to threaded apertures in the drum and requiring the use of wrenches and other tools. Liquid dispensing procedures involving the pouring or discharge of the liquid contents through a spigot or the like require that the drum normally be positioned in a horizontal manner so that the drum occupies additional horizontal space with such positioning requiring substantial manual labor. Moreover, movement of drums from a vertical to a horizontal position frequently results in accidental spillage, dropping of the drums and/or physical injury to those in the vicinity and also can create a fire hazard when the contents of the drum are flammable.

Therefore, it is the primary object of this invention to provide for a new and improved system for dispensing liquid from drum members.

Yet another object of the invention is the provision of a new and improved drum dispensing system employing easily connectable pumps which can be connected to any of a plurality of drums without any need for the use of tools for the connection function.

SUMMARY OF THE INVENTION

Achievement of the foregoing objects is enabled by the preferred embodiment of the invention which is practiced by providing a female connector in the end wall of a plurality of drums and a male connector mounted on the lower end of a manually operable pump member which can be connected to any selected drum. The male connector can be inserted into the female connector with a portion of the male connector then being rotated to maintain the male connector and its associated pump in fixed position on the drum and immediately ready for operation to effect discharging of the drum contents. A manually actuable lever on the pump is operated so as to pump the liquid contents of the drum upwardly through a discharge pipe extending downwardly to the lower portion of the drum from the female connector mounted in the upper end wall of the drum. After the drum has been emptied, the male connector and the associated pump can be removed from that particular drum by a simple manual operation. The pump can then be connected to another drum in an eqyally simple manner so as to eliminate the need for using tools to effect a mechanical connection of the pump to the drum and to also eliminate the need for any movement or handling of the drum members themselves.

A better understanding of the manner in which the preferred embodiment of the invention achieves the foregoing objects will be enabled when the following written description is considered in conjunction with the appended drawings in which like designators are used for the same parts in the different figures.

BRIEF DESCRIPTION OF THE DRAWING

FIG. 3 is a bisecting sectional view of the assembled components of FIG. 2 as mounted in the drum of FIG. 1;

FIG. 4 is a sectional view taken along lines 4—4 of FIG. 3; and

FIG. 5 is a perspective view illustrating sealing means employed with the drum when the pump is disconnected therefrom.

DESCRIPTION OF THE PREFERRED EMBODIMENT

Figure 1:
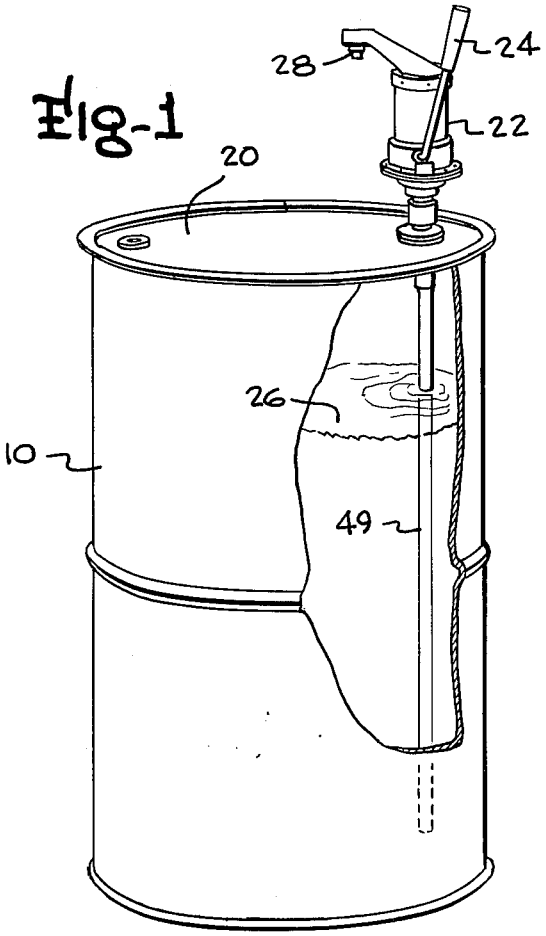
FIG. 1 is a perspective view of a drum and coupled pump as employed in the preferred embodiment of the invention.

Attention is initially invited to FIG. 1 which illustrates a conventional oil drum or the like 10 of cylindrical configuration having an upper end wall 20 with a conventional hand operated dispensing pump 22 being mounted in fittings in the upper end wall 20 in a manner to be discussed. Pump 22 is of conventional construction and includes an oscillatable actuator handle 24 which, when oscillated through an angle of approximately 180°, effects the pumping of liquid 26 contained within the drum for discharge through a discharge nozzle 28. However, it should be understood that other types of manual, or even power operated, pumps can be employed.

The lower end of the pump housing 22 is provided with a threaded coupling pipe 30 for effecting connection to drum wall 20 and a sealing gasket 32 for providing for a sealed connection thereto. A liquid input pipe 34 housing a one-way ball check valve member 36 is provided axially within coupling pipe 30. As was noted previously, the pump construction is completely conventional and any number of commercially available pumps can be employed as part of the inventive combination.

A female coupling means generally designated 40 is provided with a threaded cylindrical surface 42 which is threadably engaged with a threaded surface 44 defining an opening extending through a thickened portion 46 of the drum end wall 20. Additionally, the upper end of the female coupling means 40 includes an upper radial flange 48 having linear edge portions 50 illustrated in FIGS. 4 and 5 for permitting rotation of the coupling by a wrench or the like into or out of the thickened portion 46 of the upper end wall 20 of the drum. A seaing gasket 52 is provided beneath the upper head flange 48 to engage the upper surface of the thickened portion 46 to provide for a sealed essentially permanent mounting of the female coupling member 40 in the upper end wall 20 of the drum. A suction tube 49 is mounted in the lower end of female coupling member 40 and has its lower end positioned adjacent the bottom of the drum.

The inner surface of the female coupling member 40 includes a radial inwardly extending flange 54 (FIG. 3) above which a cylindrical surface 56 extends upwardly to a radial groove having a lower extent defined by a radial surface 58 and a cylindrical side surface 60. The upper end of the radial groove defined by side surface 60 terminates at the lower face of a radially inwardly extending flange portion 62 of the upper flange 48 as best shown in FIG. 3. However, first and second diametrically opposed groove slots 70 and 72 are provided in the radial flange 62 and extend therethrough as shown in FIG. 5. Moreover, a positioning lug 74 extends inwardly from cylindrical surface 60 adjacent each of the slots 70 for a purpose to be described hereinafter.

A male coupling component generally designated 80 is fixed to the threads of coupling pipe 30 on the lower end of the pump 22 and is dimensioned and constructed to be matingly received within the opening in the female coupling component 40 for permitting the pump 22 to be attachably connected to the female coupling component. Consequently, the pump can be easily connected to a drum for effecting the pumping of the fluid contents from the drum so as to permit usage of the pump with another drum having a similar female coupling component 40.

Figure 2:
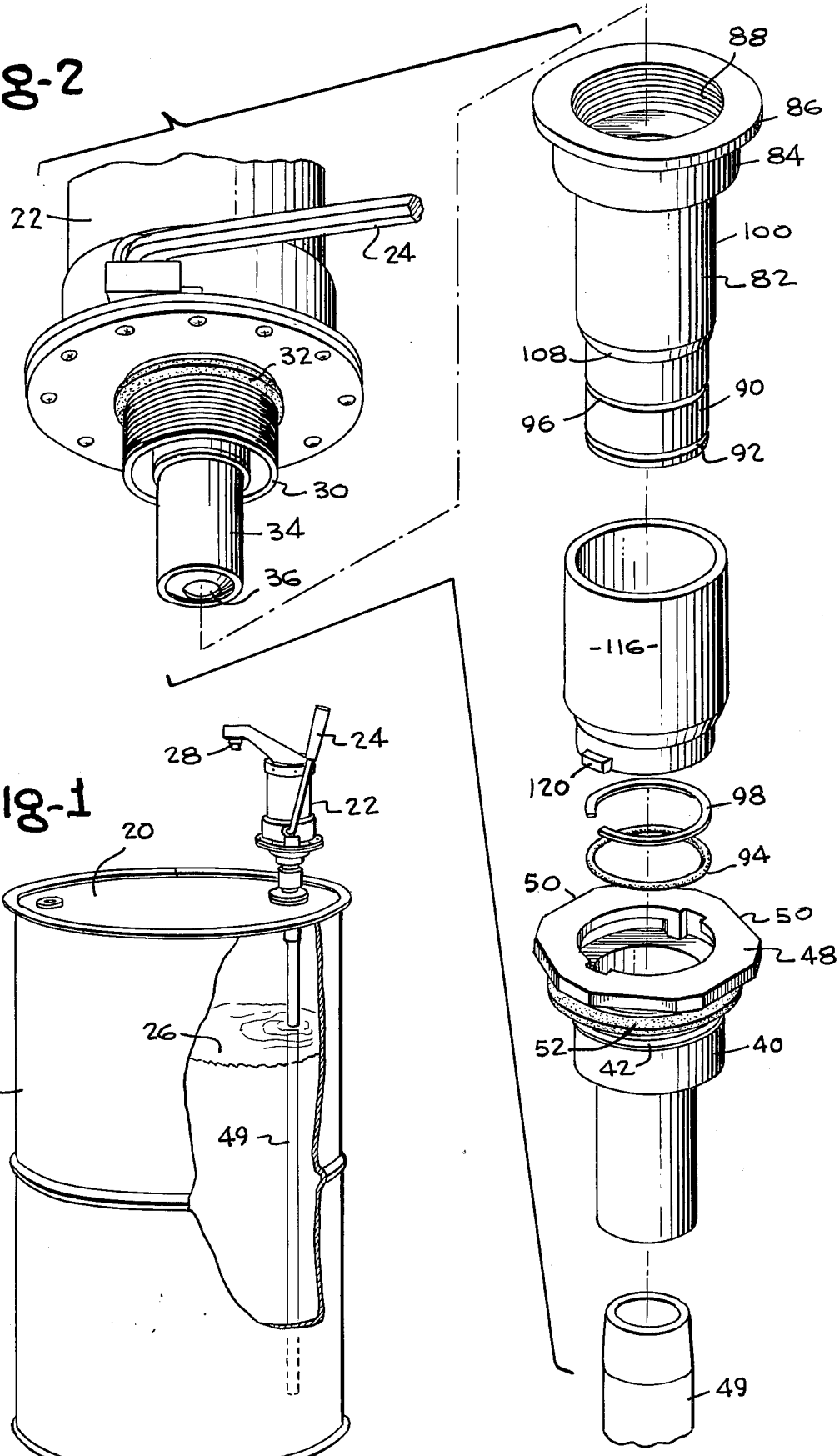
FIG. 2 is an exploded perspective view of the coupling components for connection of the pump to the drum.

Male coupling member 80 consists of an elongated tubular member 82 having an upper cylindrical coupling head portion 84 with a heat flange 86 on its upper end and a cylindrical threaded surface 88 on its interior for permitting connection to the threaded portion of coupling pipe 30 on the base of the pump member 22. It will be observed from FIG. 3 that the interior of the elongated tubular member 82 defines a passageway extending along the entire length of the member 82 and that the lower inlet pipe 34 of the pump 22 extends downwardly into this passageway in communication therewith as shown in FIG. 3. Tubular member 82 also includes a lower reduced diameter portion 90 in the lower extent of which an annular seal receiving groove 92 is provided for receiving a rubber ring seal 94. Additionally, a retainer groove 96 receives a metal retainer clip 98 for a purpose to be discussed. Reduced diameter portion 90 is joined to an intermediate portion 100 of the tubular member 82 by a conical portion 108 as best illustrated in FIGS. 2 and 3. The outer diameter of the lower portion 90 is slightly less than the diameter of the cylindrical side surface 56 of the female coupling 40 so that the ring seal 92 provides an effective seal between the aforementioned surface and the male coupling component when the parts are in the position illustrated in FIG. 3.

A coupling connector sleeve 116 is movably mounted on the member 82 and has its lower end engaged with the upper surface of the metal clip retainer means 98 so as to be held in axial position as shown in FIG. 3. However, sleeve 116 can rotate with respect to member 82 and the lower end of the connector sleeve 116 is provided with a pair of diametrically opposed outwardly extending lugs 120 which are of a width slightly less than the width of the groove slots 70.

Connection of the male coupling to the female coupling is initially accomplished by aligning the lugs 120 with the groove slots 70 and then moving the entire male connector assembly downwardly until the lugs 120 are positioned beneath the inwardly extending radial flange 62. The connector sleeve 116 is then rotated until the lugs 120 engage the sides of the positioning lugs 74 so that the lugs are beneath flange 62 and are no longer in alignment with the groove slots 70 and the male connector assembly consequently cannot be removed from its coupled relation to the female connector means 40. When it is desired to remove the pump, the connector sleeve 116 is simply rotated in a reverse direction until the lugs 120 are again in vertical alignment with the groove slots 70 and the entire pump and male connector assembly is then lifted upwardly and outwardly of the female connector portion 40.

Upon removal of the pump assembly, a closure plug 140 illustrated in FIG. 5 can be positioned in the female connector assembly for protecting the interior of the drum from contamination. Closure plug 140 includes a lower cylindrical portion 142 and a pair of diametrically opposed lugs 120' of the same size and shape as the lugs 120 which are positioned in the groove slots and moved to the lower position and then rotated to effect a closure of the drum in the same manner that the male connector 82 is mounted in the female connector. A gasket 146 on the lower surface of the closure means 140 provides sealing connection between the closure means and the drum in an obvious manner.

While numerous modifications of the subject invention will undoubtedly occur to those of skill in the art, for example, the pump and coupling components can be made of material other than plastic such as brass, steel, etc.; therefore, it should be understood that the spirit and scope of the invention is to be limited solely by the appended claims.

I claim:

1. A liquid dispensing system comprising drum means, said drum means having an upper end wall, a female coupling means essentially permanently mounted in said upper end wall, suction tube means extending from said female coupling means downwardly adjacent the lower end of said drum, a male connector member having a mating portion insertable in sealing relationship to said female coupling means, rotary retaining means on said male connector member effective for maintaining said male connector member in coupled relation to said female coupling means, selectively operable pump means connected to said male coupling member to communicate with said suction tube when said male connector member is mounted in said female coupling whereby operation of said pump means when said male connecting member is coupled to said female connecting member results in the dicharge of liquid from the interior of the drum, wherein said female coupling member comprises an elongated tubular fitting including a central passageway communicating with said suction tube, an upper radial flange, a threaded external cylindrical surface on said tubular fitting positioned beneath said upper radial flange dimensioned to be threadably connected to a threaded opening in the upper end wall of said drum means and said central passageway extending through said head flange and being dimensioned to receive said male connector member, said central passageway including an inner radially extending arcuate groove beneath said head flange and wherein said head flange additionally includes radially outwardly extending groove slots on opposite sides of the upper end of said central passageway in said head flange and wherein said male connector member includes radially outwardly extending lugs having outer dimensions slightly less than the dimensions of said groove slots and being of a vertical thickness slightly less than the thickness of said inner radially extending arcuate groove of said tubular fitting whereby said lugs can be moved downwardly through said groove slots and subsequently rotated to position said lugs in said arcuate groove for maintaining said male connector member in coupled connection to said female connector member and wherein said male connector member comprises a unitary tubular member comprising a reduced diameter bottom portion, an upper coupling head portion having an internal threaded surface threaded onto said pump, an internal passageway extending the length of said unitary tubular member, a check valve in the lower end of said internal passageway for preventing flow from said internal passageway and seal means on said reduced diameter bottom portion engageable with said central passageway when said male connector member is mounted in said female coupling means to define a continuous flow path from said suction tube to said pump.

2. The invention of claim 1 wherein said female coupling means is formed of plastic.

3. The invention of claim 1 wherein said male connector member additionally includes a rotary sleeve axially mounted on the exterior of said unitary tubular member and wherein said radially outwardly extending lugs extend outwardly from a lower portion of said rotary sleeve.

4. A liquid dispensing system comprising drum means, said drum means having an upper end wall, a female coupling means essentially permanently mounted in said upper end wall, suction tube means extending from said female coupling means downwardly into said drum and terminating at a lower end portion adjacent the lower end wall of said drum, a male connector member having a mating portion insertable in sealing relationship to said female coupling means, rotary retaining means on said male connector member effective for maintaining said male connector member in coupled relation to said female coupling means, selectively operable pump means connected to said male coupling member to communicate with said suction tube when said male connector member is mounted in said female coupling whereby operation of said pump means when said male connecting member is coupled to said female connecting member results in the discharge of liquid from the interior of said drum, wherein said male connector member, said female coupling means and said pump are essentially formed of plastic, wherein said female coupling member comprises an elongated tubular fitting including a central passageway communicating with said suction tube, an upper radial flange, a threaded external cylindrical surface on said tubular fitting positioned beneath said upper radial flange dimensioned to be threadably connected to a threaded opening in the upper end wall of said drum means and said central passageway extending through said head flange and being dimensioned to receive said male connector member, said central passsageway including an inner radially extending arcuate groove beneath said head flange and wherein said head flange additionally includes radially outwardly extending groove slots on opposite sides of the upper end of said central passageway in said head flange and wherein said male connector member includes radially outwardly extending lugs having outer dimensions slightly less than the dimensions of said groove slots and being of a vertical thickness slightly less than the thickness of said inner radially extending arcuate groove of said tubular fitting whereby said lugs can be moved downwardly through said groove slots and subsequently rotated to position said lugs in said arcuate groove for maintaining said male connector member in coupled connection to said female connector member and wherein said male connector member comprises a unitary tubular member including a reduced diameter bottom portion, an upper coupling head portion having an internal threaded surface threaded onto said pump, an internal passageway extending the length of said unitary tubular member, a check valve in the lower end of said internal passageway for preventing flow from said internal passageway and seal means on said reduced diameter bottom portion engageable with said central passageway when said male connector member is mounted in said female coupling means to define a continuous flow path from said suction tube to said pump.

* * * * *